US005679010A

United States Patent [19]

Hotea et al.

[11] Patent Number: 5,679,010

[45] Date of Patent: Oct. 21, 1997

[54] ANTI-FRETTING TERMINAL FOR PCB

[75] Inventors: Gheorghe Hotea, Greisheim; Mile Trajkov, Frankfurt; Michael Schecker, Griesheim, all of Germany

[73] Assignee: The Whitaker Corporation, Wilmington, Del.

[21] Appl. No.: 571,659

[22] Filed: Dec. 13, 1995

[30] Foreign Application Priority Data

Dec. 20, 1994 [GB] United Kingdom ..... 9425740

[51] Int. Cl.[6] ..... H01R 9/09

[52] U.S. Cl. ..... 439/81; 439/296

[58] Field of Search ..... 439/81, 853, 252, 439/78, 83, 82, 296, 297, 298

[56] References Cited

U.S. PATENT DOCUMENTS

| | | | |
|---|---|---|---|
| 3,403,369 | 9/1968 | Steiff et al. . | |
| 3,805,220 | 4/1974 | Silbermann | 339/258 R |
| 4,654,753 | 3/1987 | Turk et al. | 361/388 |
| 4,786,262 | 11/1988 | Molitor et al. | 439/843 |
| 4,810,215 | 3/1989 | Kaneko | 439/845 |
| 4,824,380 | 4/1989 | Matthews | 439/78 |
| 5,112,235 | 5/1992 | Enomoto et al. . | |

FOREIGN PATENT DOCUMENTS

| | | | |
|---|---|---|---|
| 041188A2 | 2/1991 | European Pat. Off. | H01R 13/11 |
| 0492479A2 | 7/1992 | European Pat. Off. | H01R 13/187 |
| 0637854A2 | 2/1995 | European Pat. Off. | H01R 9/09 |
| 4034423A1 | 5/1991 | Germany | H01R 9/09 |
| 4103423C2 | 8/1991 | Germany | H01R 13/11 |
| 4018206A1 | 12/1991 | Germany | H01R 9/09 |
| 4109519A1 | 9/1992 | Germany | H01R 23/72 |
| 4419815C1 | 9/1995 | Germany | H01R 9/09 |

*Primary Examiner*—Gary F. Paumen
*Assistant Examiner*—Christopher Goins

[57] ABSTRACT

A terminal for mounting on a printed circuit board (PCB) has a receptacle contact portion for receiving a complementary pin therein between contact arms. The contact section is connected to the PCB connection section by long spring arms that comprise a series of spring beams oriented in different planes. The spring arms are thus supple in X, Y and Z directions to allow great floatability of the contact sections with respect to the PCB.

15 Claims, 5 Drawing Sheets

ANTI-FRETTING TERMINAL FOR PCB

BACKGROUND OF THE INVENTION

1. Field of the Invention

This invention relates to a terminal for mounting on a printed circuit board (PCB), the terminal having a contact section floatable with respect to the printed circuit board for compensation of misalignment and prevention of relative movement between the contact section and a complementary terminal mated thereto.

2. Description of the Prior Art

In certain printed circuit board (PCB) applications, for example in the automotive industry, it is desirable to have PCB receptacle contacts that have a contact section which is floatable with respect to the PCB. An example of such a PCB is that of an automobile dashboard where components such as the fuel gage, tachometer etc. have pin contacts that are plugged into receptacle contacts mounted on the dashboard PCB for electrical connection to circuit traces thereof. Due to constructional tolerances, and thermal and inertial movements, it is desirable to have the receptacle portion of the PCB contact movable in all directions parallel to the PCB, and in a direction orthogonal thereto. Hereinafter we shall consider that the three degrees of freedom are denoted X, Y and Z, where X and Y are orthogonal with respect to each other but parallel to the plane of the printed circuit board, and Z a direction orthogonal thereto. Floatability in the X, Y directions mainly has the function of adjusting to tolerance mismatch and thermal dilatation between the PCB and the components, and the Z direction floatability mainly has the function of preventing relative movement between the component pin contacts (which are insertable into the receptacle contacts in the Z direction) and the receptacle contact, thus preventing fretting corrosion therebetween, in particular with respect to inertial forces.

In certain applications, the required tolerance adjustment in the X, Y direction can be in the order of one or two times the pin contact diameter. There is no satisfactory prior art PCB contact that allows such large tolerance adjustments, whilst nevertheless preventing fretting corrosion and furthermore having a reliable, compact and cost-effective design.

SUMMARY OF THE INVENTION

It is therefore an object of this invention to provide a receptacle terminal for mounting on a PCB, the receptacle terminal having a contact section floatable with respect to the PCB, the terminal being reliable, compact and cost-effective.

It is a further object of this invention to provide a floatable receptacle terminal for mounting on a printed circuit board that can tolerate large displacements in any direction in the plane of the printed circuit board, whilst nevertheless reliably preventing fretting corrosion with respect to a pin contact mated therewith.

The objects of this invention have been achieved by providing a receptacle contact comprising a printed circuit board connection section, a receptacle contact section, and a spring section extending therebetween, the spring section comprising a plurality of supple beams stamped and formed from sheet metal that is bent into different planes that comprise the spring beams, there being at least three spring beams that are supple in three different directions respectively to allow floatability in three degrees of freedom.

In an embodiment, three of the planes within which the spring beams are parallel to are mutually orthogonal.

DETAILED DESCRIPTION OF THE PREFERRED EMBODIMENT

Figure 2:
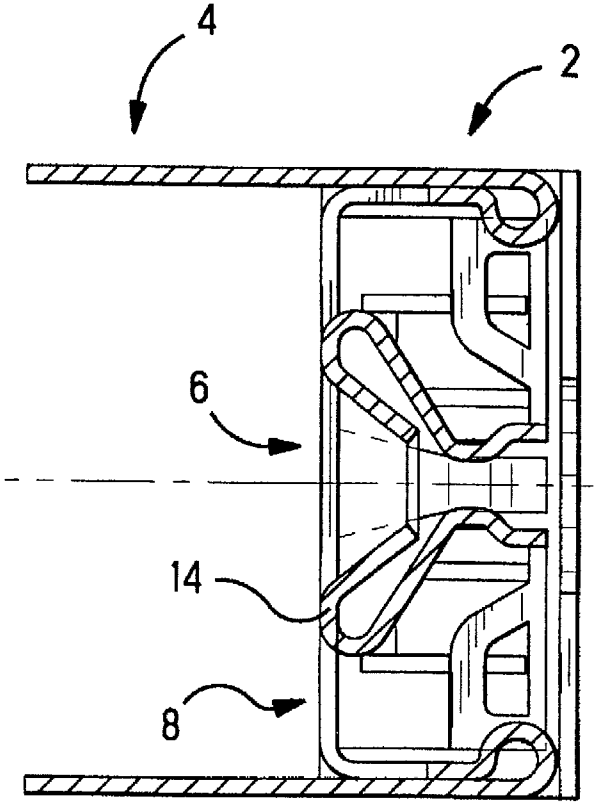
FIG. 2 is a cross-sectional view through lines 2—2 of FIG. 1.
Figure 1:
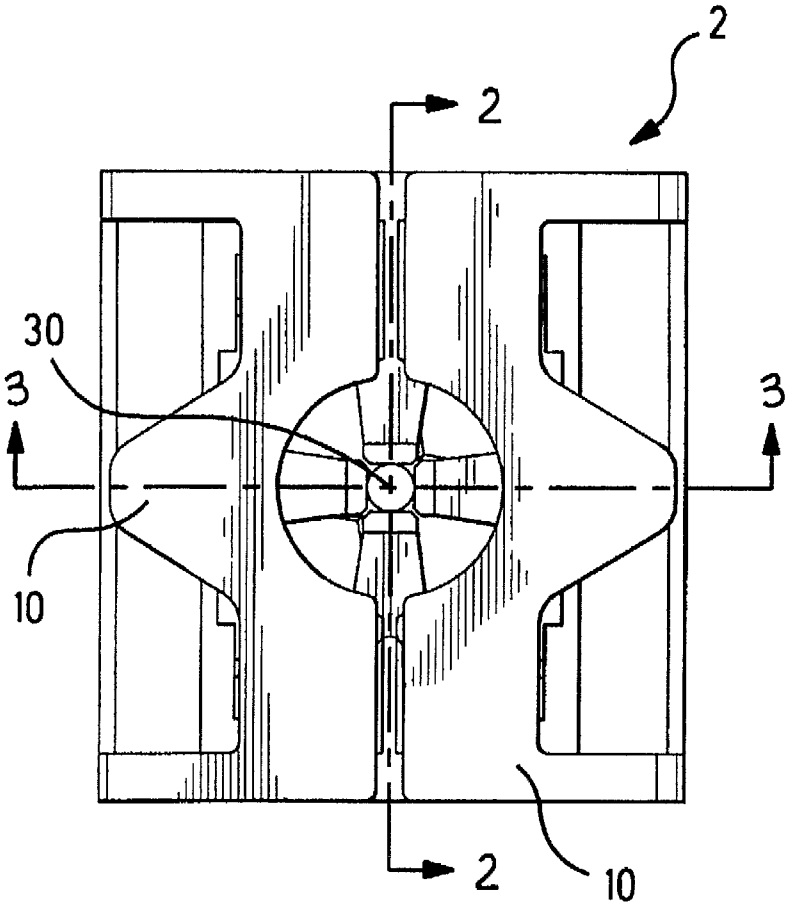
FIG. 1 is a top view of a PCB receptacle contact according to this invention.
Figure 4:
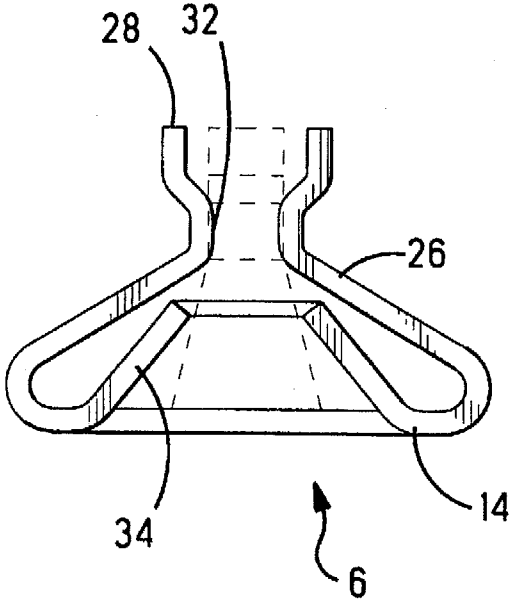
FIG. 4 is a cross-sectional view through a receptacle contact section of the receptacle terminal.
Figure 3:
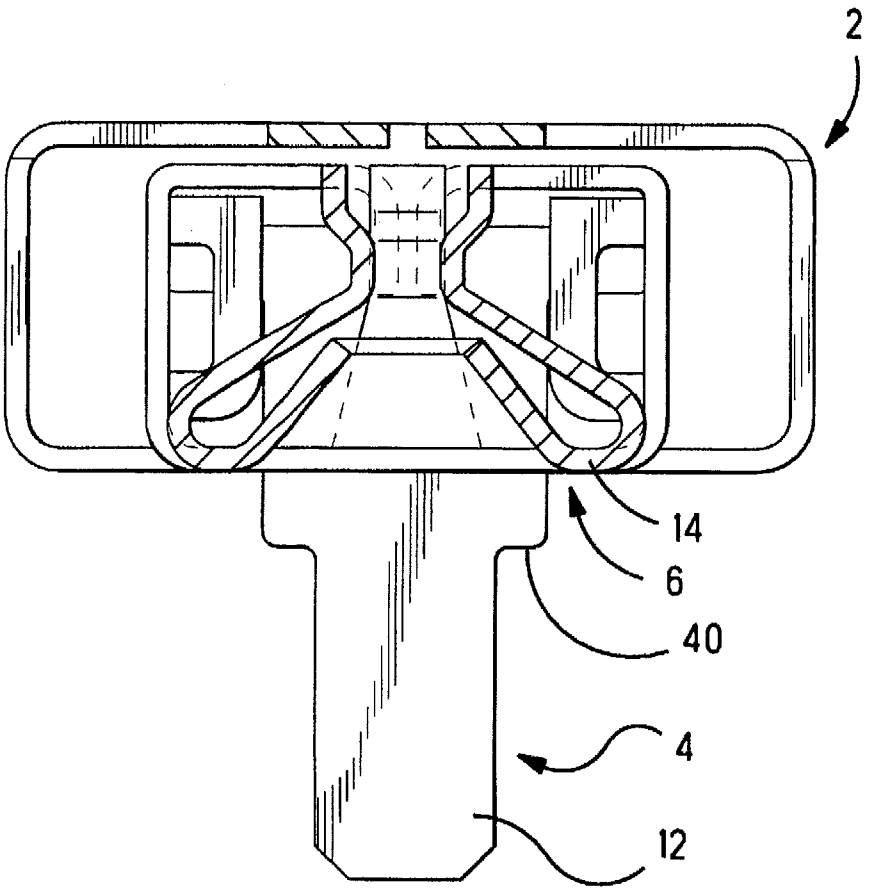
FIG. 3 is a cross-sectional view through lines 3—3 of FIG. 1.

Referring to FIGS. 1–7, A receptacle contact 2 comprises a printed circuit board connection section 4, a contact section 6 interconnected to the PCB connection section 4 via a spring section 8, and cover part 10.

The PCB connection section 4 comprises a pair of spaced apart tabs 12 extending below a base wall 14 of the contact section 6, the tabs 12 extending into side walls 16 that further extend in to reversely bent bridging portions 18 proximate the cover parts 10 that further extend to corner base wall portions 15. The cover part 10 comprises a pair of half top walls 20 that are interconnected to the corner base wall portions 15 via end wall portions 22 that are orthogonal to the top wall and to the side walls 16. The corner base wall portions 15 are situated at each corner 24 of the terminal 2.

The contact section 6 comprises cantilever beam contact arms 26 that are folded up from the base wall 14 and have free ends 28 proximate the top wall 10. There are two pairs of opposed contact arms 26 in perpendicular orientations with respect to each other that form a pin receiving cavity 30. Contact protrusions 32 of the contact arms 26 project into the cavity 30 for contacting a pin received therein. Extending from the base wall 14 towards the top wall 10 are guide tabs 34 that form a funnel for guiding and positioning a pin contact in the contact cavity area 30. The guide tabs 34 form a roughly truncated conical form having a large diameter at the base portion 36 and a relatively small diameter at their free ends 38. The guide tabs have the important function of not only preventing overstressing of the contact arms 32, but also due to the large tolerance adjustment the lower end 36 of the funnel must have a large catchment area for adjustment to large tolerances in the position of the mating pin.

Figure 5:
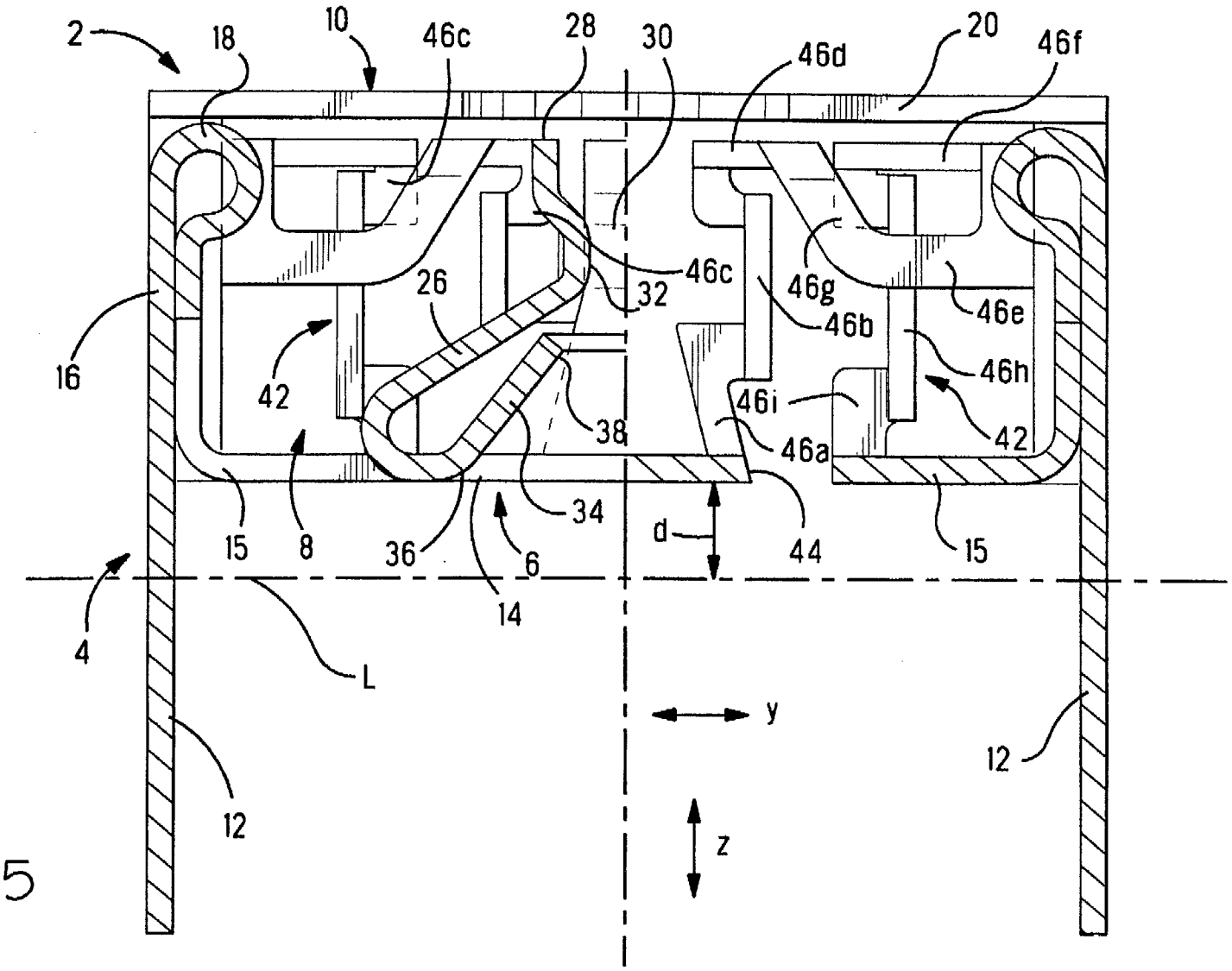
FIG. 5 is a similar view to that of FIG. 2 but with the receptacle contact section removed for more clarity.

The receptacle terminal 2 is positioned on a PCB where the upper surface of the PCB is approximately at the line L shown in FIG. 5 which is positioned at a certain distance D from the base walls 14,15. The latter allows a certain vertical movement (direction Z) of the contact section 6 with respect to the PCB. The PCB connection tabs 12 are insertable into a hole in the PCB and abut opposing sides of the hole where shoulders 40 (see FIG. 3) abut the edge of the PCB hole to provide the distance D between the PCB and base wall 14.

Figure 6:
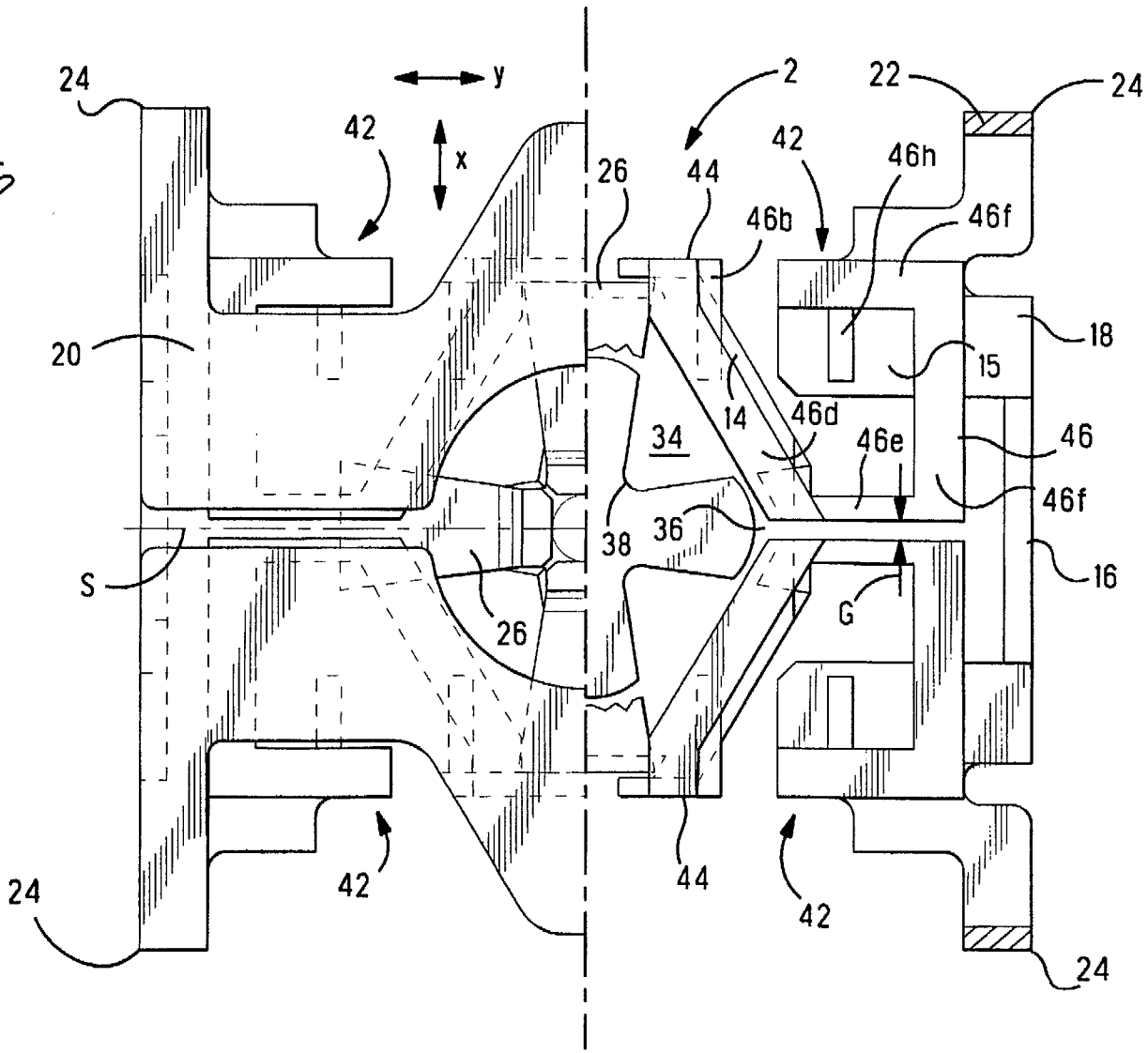
FIG. 6 is a similar view to that of FIG. 1 but with cover parts removed, and contact arms broken off for more clarity.

The spring section 8 comprises four spring arms 42 (see FIGS. 5 and 6) that extend between the corner base wall portions 15 at respective corners 24 of the terminal 2, to corners 44 of the contact section base wall 14 through a series of spring beams 46 that are folded into different planes. In order to explain the orientation of the planes more clearly, directions X, Y and Z which are mutually orthogonal and define cartesian axes will define the directions as shown in FIGS. 5 and 6. Planes X, Y and Z will be defined as planes orthogonal to axes X, Y and Z respectively. To further clarify, a spring beam 46 that is described to be in a certain plane X, Y or Z, means that the plane of the sheet metal from which it is stamped and formed is substantially parallel to the specified plane.

Each spring arm 42 comprises a first spring beam 46*a* in the X plane that extends from a corner 44 of the contact section base wall 14. Bent orthogonally therefrom via an L-shaped portion and extending towards the top wall 10 is a second spring beam 46*b* in the Y plane; further extending via an L-shaped portion orthogonally thereto to a joining portion 46*c;* further extending through an L-shaped portion orthogonally thereto into a third spring beam 46*d* that is in a Z plane proximate the top wall 20. The third spring beam 46*d* further extends via an L-shaped bridging portion orthogonally thereto into a substantially V-shaped fourth spring beam 46*e* that is in an X plane and proximate a central line of symmetry S (see FIG. 6) of the terminal 2 but separated from its symmetrical counterpart by a gap G. The fourth spring beam 46*e* further extends through an L-shaped portion orthogonally into a fifth spring beam 46*f* proximate the top wall 20, the fifth spring beam 46*f* further extending into a joining portion 46*g* in the X plane which further extends into a sixth spring beam 46*h* that extends towards the base wall 15 and is in the Y plane; the sixth spring beam further extending into a seventh spring beam 46*i* in the Z plane, and is attached to a respective corner base wall portion 15.

Spring beams are far more supple in a direction perpendicular to the plane of the metal sheet than within the plane. First and seventh spring beams 46*a*,46*i* as well as fourth spring beam 46*e* thus all contribute to great flexibility of the contact sections 6 with respect to the corner base wall portions 15 (and thus the PCB) in the X direction. The sum of the spring beam lengths 46*a*,46*i*,46*e* is relatively long in comparison to the size of the terminal 2 and thus enable great floatability of the contact sections 6 in the X direction. The lateral remark is pertinent for both directions Y and Z for similar reasons. The spring beams 46*b*,46*h* contribute to great flexibility in the Y direction, and the spring beams 46*d*,46*f* contribute to great flexibility in the Z direction.

Due to the extension of the spring arm 42 from the base wall 14 towards the top wall 10, across the top wall to the symmetry line S, down towards the base wall and back up again towards the top wall through spring beam 46*e*, back towards the end walls through an L-shaped spring beam 46*f* and back down to the corner wall portions 15, a very long spring arm is provided that is supple in all directions X, Y and Z thus allowing great flexibility of the contact section 6 with respect to the PCB. Due to the supple spring support, the contact section is limited in its Z direction movement by the top wall 10 and the PCB when mounted thereto and is limited in the X and Y directions by the corner base wall portions 15.

Figure 7:
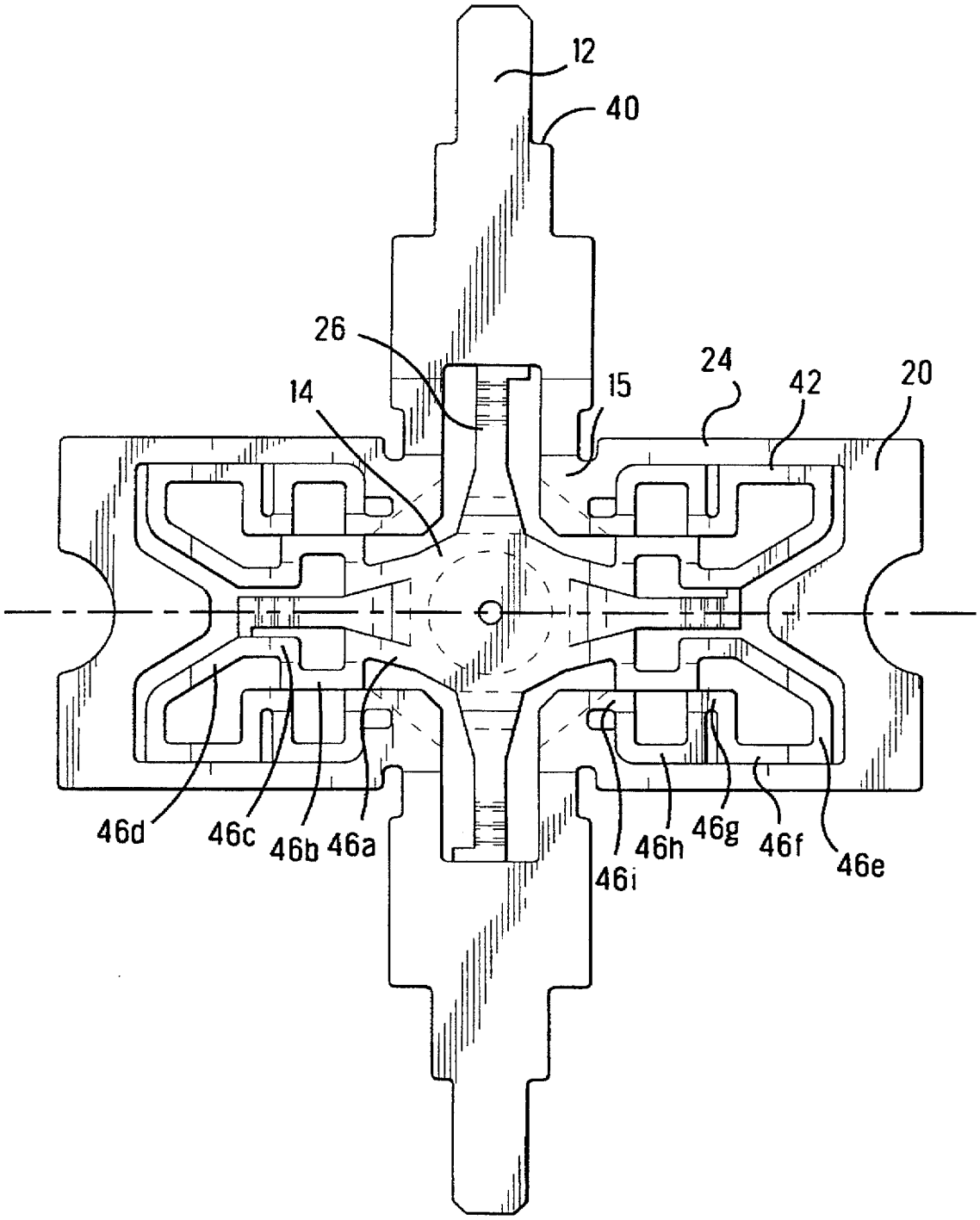
FIG. 7 is the stamped layout of the terminal of the previous figures.

Referring to FIG. 7, the stamped layout of the terminal 2 is relatively compact whereby the spring arms 42 are comprised within the bounds of the end and top walls 22,20.

Advantageously therefore, the terminal 2 has a contact section 6 that is floatable in X, Y and Z directions by means of very supple but very compact spring arms 42. Additionally, the terminal 2 is stamped and formed from a unitary part of sheet metal.

We claim:

1. An electrical terminal for mounting on a printed circuit board comprising a connection section, a pin receiving contact section, and a spring section therebetween for enabling floating movement of the contact section with respect to the connection section, characterized in that the spring section comprises a succession of supple spring beams where adjacent spring beams are oriented in different planes transverse to one another, the number of planes within which the spring beams are oriented being at least three to enable floatability in directions X, Y and Z of a cartesian system.

2. The terminal of claim 1 wherein the spring section comprises at least three spring arms extending between the pin receiving contact section and the connection section, each of the spring arms comprising a succession of the supple spring beams.

3. The terminal of claim 2 wherein the terminal is rectangular-shaped and comprises four spring arms extending from respective corners of the rectangular shape, to the pin receiving contact section, which is centrally placed within the rectangle.

4. The terminal of claim 3 wherein the terminal is symmetric about planes X and Y, which are orthogonal to directions X and Y respectively.

5. The terminal of claim 1 wherein the spring section extends from a base wall proximate the connection section to proximate a top end, wherein the contact section extends and is attached to the base wall.

6. The terminal of claim 5 wherein a top wall is provided at the top end, the top wall limiting floatability of the spring section upwards in the Z direction.

7. The terminal of claim 5 or 6 wherein the connection section comprises one or more tabs for mounting in a hole of a printed circuit board (PCB), and one or more stops for abutment with the PCB such that the base wall is spaced at a certain distance from the PCB for limited floatability in the Z direction.

8. The terminal of claim 7 wherein the stops are shoulders on the PCB tabs.

9. The terminal of claim 1 wherein the spring beams are substantially planar and stamped and formed from sheet metal.

10. The terminal of any of claims 5, 6, or 9 wherein the contact section comprises cantilever beam contact arms that extend from the base wall where they are attached to free ends proximate the top wall.

11. The terminal of claim 9 wherein the contact section comprises guide tabs extending obliquely inwardly from the base wall and overlapping an entry portion of the contact arms to form a funnel for guiding a mating pin contact into the contact section.

12. The terminal of claim 11 wherein there are two pairs of opposed contact arms, the pairs disposed orthogonally in relation to each other.

13. The terminal of claim 11 wherein there is one guide tab for each contact arm.

14. The terminal of claim 1 wherein the terminal is an integral part stamped and formed from sheet metal.

15. The terminal of claim 1 wherein the adjacent spring beams are folded at right angles with respect to each other.

* * * * *